United States Patent [19]

Lockwood

[11] Patent Number: 4,776,139

[45] Date of Patent: Oct. 11, 1988

[54] BUILDING PANELS

[76] Inventor: David N. Lockwood, 6191 Ewart Street, Burnaby, British Columbia, Canada, V5J 2X4

[21] Appl. No.: 19,330

[22] Filed: Feb. 26, 1987

Related U.S. Application Data

[63] Continuation of Ser. No. 647,017, Sep. 4, 1984, Pat. No. 4,672,780.

[51] Int. Cl.[4] ..... E04C 2/32; E04C 2/38

[52] U.S. Cl. ..... 52/82; 52/537; 52/630; 52/741; 52/DIG. 10; 29/432.1; 29/505; 29/557; 29/DIG. 3

[58] Field of Search ..... 52/71, 82, 741, 81, 52/630, 547, 537, 450, DIG. 10, 792; 29/17 R, 19, 432, 432.1, 438, 469.5, 505, 557, 558, 39 R, DIG. 3

[56] References Cited

U.S. PATENT DOCUMENTS

| | | | |
|---|---|---|---|
| 2,616,530 | 11/1952 | Horowitz | 52/630 X |
| 3,148,481 | 9/1964 | Swann | 52/630 X |
| 3,389,513 | 6/1968 | Ruggles | 52/82 |
| 3,427,767 | 2/1969 | Schaefer | 52/537 X |
| 3,524,288 | 8/1970 | Coppa | 52/71 X |
| 3,798,852 | 3/1974 | Nicoll, Jr. | 52/630 |
| 3,995,081 | 11/1976 | Fant et al. | 52/630 X |
| 4,672,780 | 6/1987 | Lockwood | 52/82 |

FOREIGN PATENT DOCUMENTS

| | | | |
|---|---|---|---|
| 221254 | 4/1959 | Australia | 52/630 |
| 540022 | 3/1977 | U.S.S.R. | 52/82 |

*Primary Examiner*—David A. Scherbel
*Assistant Examiner*—Richard E. Chilcot, Jr.
*Attorney, Agent, or Firm*—Fetherstonhaugh & Co.

[57] ABSTRACT

Integral, elongated panels have sets of converging corrugations arranged on lines defined by folded, transversely triangular elements. These elements extend laterally across the panel, and are dimensioned such that a pair of adjacent parallel side edges of two corresponding panels can mate. Preferably, each corrugation has a planar element arranged on lines generally perpendicular to the side edge defining congruent elements with triangular faces meeting at the apex.

By such arrangement, a panel is obtained which in conjunction with other such panels, can produce a curved surface, which curvature may be reversed in direction in any point along a structure surface, by inverting the next adjacent series of panels.

11 Claims, 9 Drawing Sheets

FIG. 15.
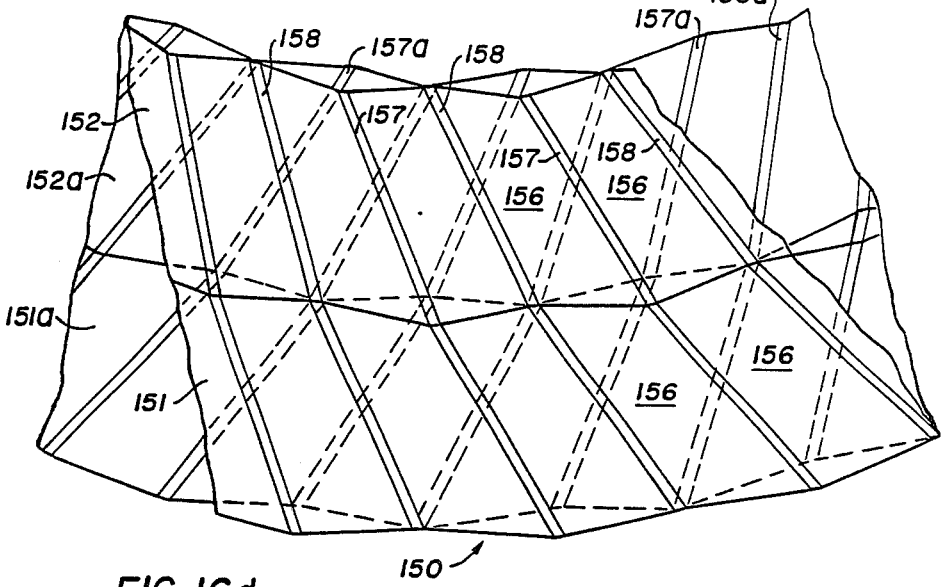
FIG. 16d.
FIG. 17d.
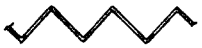
FIG. 16a.
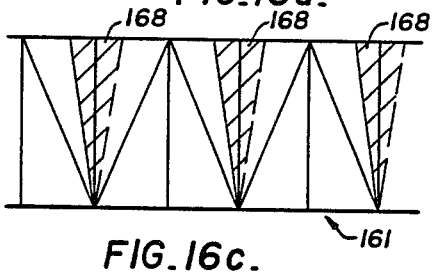
FIG. 17a.
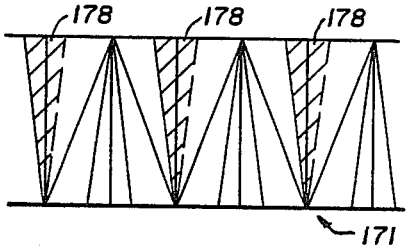
FIG. 16c.
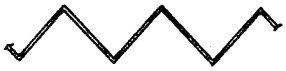
FIG. 17c.
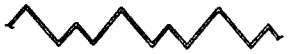
FIG. 16.
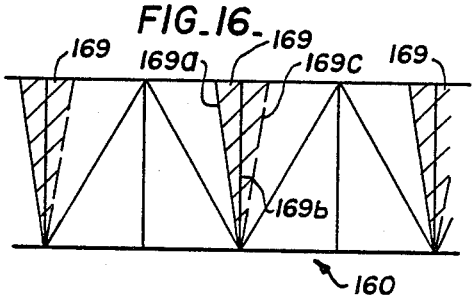
FIG. 17.
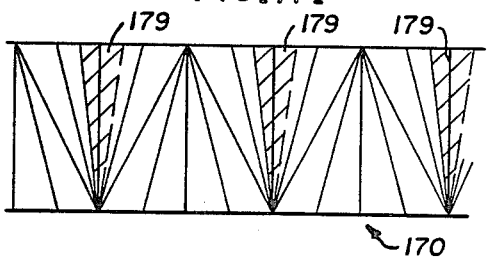
FIG. 16b.
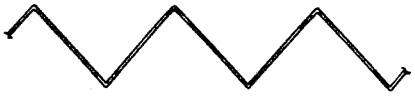
FIG. 17b.
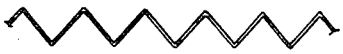

BUILDING PANELS

This application is a continuation application of application Ser. No. 647,017, filed 9-4-84, now U.S. Pat. No. 4,672,780.

FIELD OF THE INVENTION

This invention relates to building panels useful in constructing a variety of structures.

DESCRIPTION OF THE PRIOR ART

In attempts to minimize building construction time, and construction costs, numerous types of building panels have been devised which are prefabricated and can be connected together to produce surfaces in a building or structure. In designing such panels, it is desirable to produce a panel which can produce structurally strong walls or the like, and which also retains a fair degree of flexibility, such that structures of varying shapes can be constructed utilizing panels of the same basic shape.

Examples of panels which have attempted to meet the above requirements, are disclosed in U.S. Pat. Nos. 3,389,513 to Ruggles and 3,439,456 to Silberkuhl. The panel disclosed in the Ruggles patent consists of two opposed, folded triangular sections disposed about the middle of the panel, and extending lengthwise thereon. The portions of the panel between the folded sections and side edges of the panel are flat, and are provided at their edges with flanges by which the side edges of adjacent panels can be connected together. This requires that such panel described be formed individually. When it is then desired to construct a structure surface using such panels, the panels must be individually connected together. In addition, panels with adjacent connected side edges cannot be inverted with respect to one another, so as to produce a structural surface which has a varying direction of curvature as desired. Each of the panels of the Silberkuhl patent, on the other hand, consists of a generally rectangular panel with a lengthwise extending folded triangular section thereon. The remainder of the panel is flat and extends to flanges thereon. It is possible to arrange adjacent sets of such panels to be disposed at an angle to one another, as described in the patent. However, again, as in the panel in the Ruggles patent, each of the panels must be individually connected together through their flanges. In addition, due to the shaping of each individual panel and the presence of its particular flanges, it is again not readily possible to reverse the direction of curvature of a structure surface by simply inverting some of the connected panels.

U.S. Pat. No. 3,914,486 to Borgford further discloses a three dimensional panel structure apparently formed from a unitary sheet. However, such a panel apparently does not allow reversing curvature to be obtained in a structure surface using such panels by simply inverting such panels. Further particular panels are disclosed in U.S. Pat. No. 4,145,850 to Runyon, U.S. Pat. No. 3,668,796 to Patterson, and U.S. Pat. No. 4,227,334 to Hooker.

SUMMARY OF THE INVENTION

The present invention provides an integral, elongated panel. Such panel comprises sets of converging corrugations arranged on lines defined by folded, tranversely triangular elements extending laterally across the panel section, such that a pair of adjacent parallel side edges of two corresponding panels, can mate. In one arrangement, the converging corrugations extend laterally across the panel in alternating direction.

Preferably, each corrugation has a planar element arranged on lines generally perpendicular to the side edge defining congruent elements with triangular faces meeting at the apex. In such case, the transversely triangular elements contain sloping side edge portions of the panel, such that a pair of adjacent parallel side edges of two such panels, can mate when the panels are laterally inclined toward one another. In addition, each panel may usefully be provided with single corrugations alternating in direction or may be provided with a grouping of more than one corrugation converging at one side edge. The alternating sets of converging corrugations may extend only part way along the length of the lines defining the folded transversely triangular elements, so that a panel contains only truncated elements or extend along the entire length thereof so that a panel contains a plurality of such entire elements.

The panel may be constructed with first and second side edges thereof, generally curved, with the first side edge having a greater radius of curvature than the second side edge. In such case the tranversely triangular elements are all radially aligned (that is, directed or pointed toward a common center of a circle on which the panel lies), and directed toward the second side edge. In addition, first side edge portions of a first set of alternate elements are lower than respective opposite side edge portions. Second side edge portions of elements of a second set of alternate elements interposed with those of the first set, are also lower than respective opposite first side edge portions thereof, with the second side edge portions of the elements of the second set being lower (i.e. of less height between the base and apex of the corrugations) than the first side edge portions of the elements of the first set. By such arrangement the first side edge of a first such panel can mate with an adjacent congruent second side edge of a second panel, when the second panel is inclined downwardly with respect to the first panel (the "downward" direction being toward the base lines defining the corrugations).

A method of forming panels as described is further provided, which method comprises folding a flat sheet having parallel side edges to produce the converging corrugations. In the case of the panel described with generally curved side edges, the method further includes forming triangular darts on the side edges of the sheet.

An elongated panel is further provided, which comprises a first set of coplanar, parallel faces extending laterally across the panel at an angle to the side edges of it. A second set of coplanar faces are provided which extend parallel with the faces of the first set and laterally across the panel in alternating relationship with the faces of the first set. The second set is also disposed in a plane parallel to that in which the first set of faces lies. An elongated panel structure can be created from such panels, utilizing at least two panels of the foregoing construction. The panels are disposed parallel to one another with adjacent connected faces, and orientated such that the faces of one panel, extend across the panel structure in a direction opposite to that of the faces of the other panel. Preferably, the faces of each panel in the panel structure, extend at an angle of 45 degrees between the side edges thereof.

Further panel structures may be created utilizing other panels as previously described, and a reinforcing, elongated panel disposed with a face thereof connected to a face of the first panel. Methods of constructing a structure surface from a plurality of panels as described, are also provided. The methods include forming such panels by folding sheet metal coil stock, as well as providing darts where necessary. In use, the panels are positioned with mating side edges parallel and adjacent to one another, such mating side edges then being connected by means of welding, screws, or other suitable fastening means. If desired, at the same time, or shortly before or thereafter, a plurality of reinforcing panels as described, can also be formed from sheet metal coil stock, which then have their faces joined to respective faces of the first panels. In one particular method, the panels are formed from sheet metal coil stock and connected together, as the structure surface is raised.

DRAWINGS

Embodiments of the invention will now be described with reference to the drawings, in which.

Figure 2:
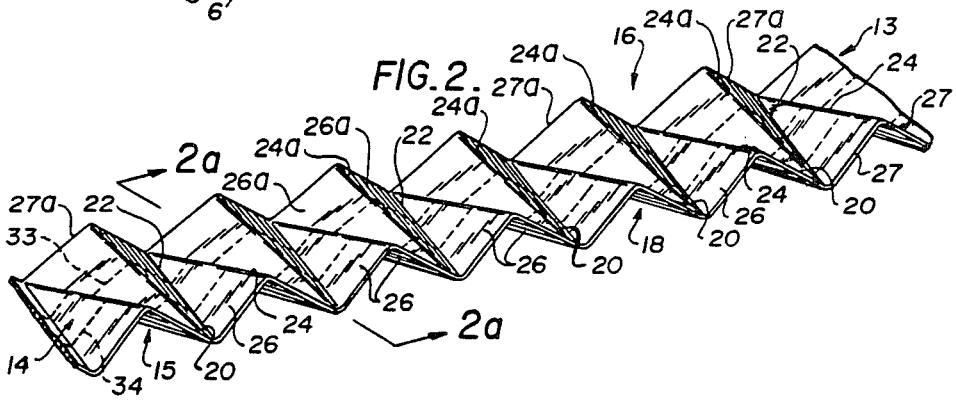
FIG. 2 is a perspective view of a panel of the present invention.
Figure 3:
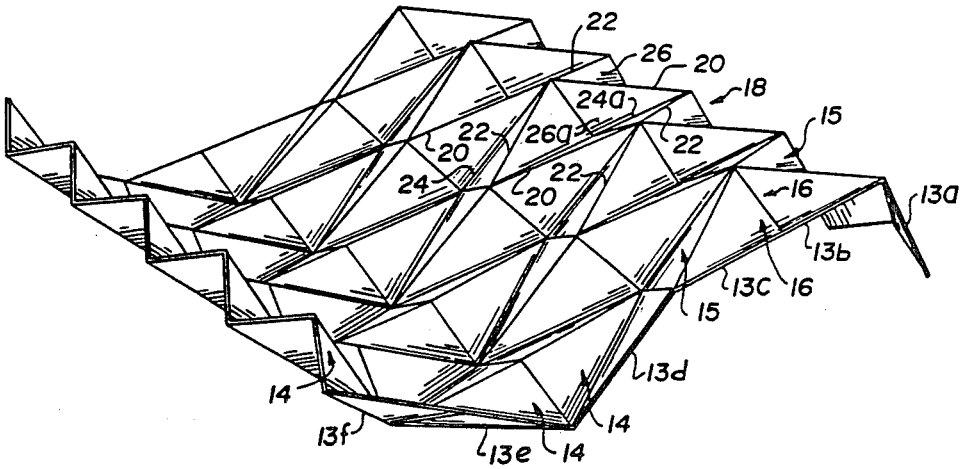
Figure 2A:
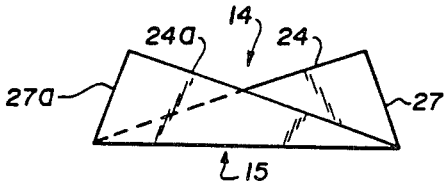
Figure 3A:
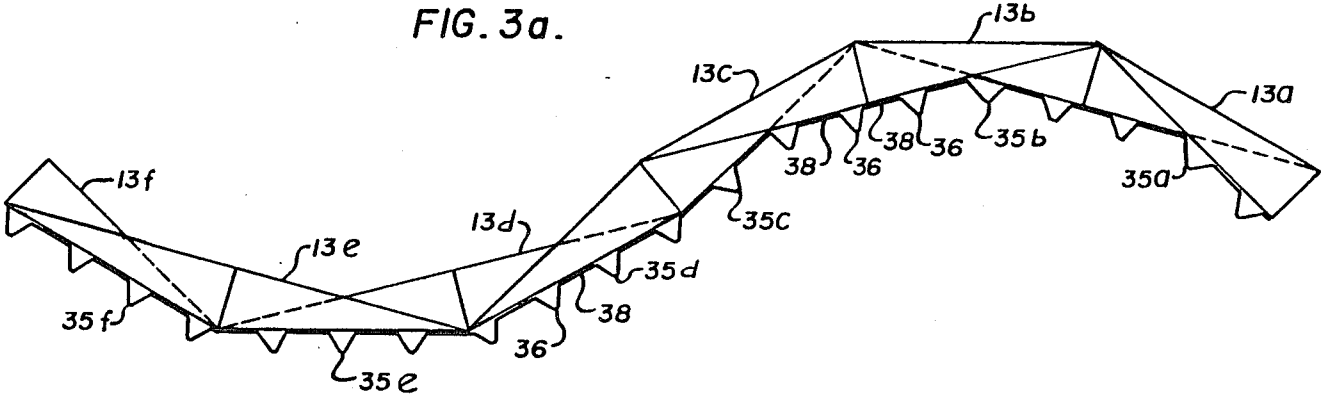
Figure 4:
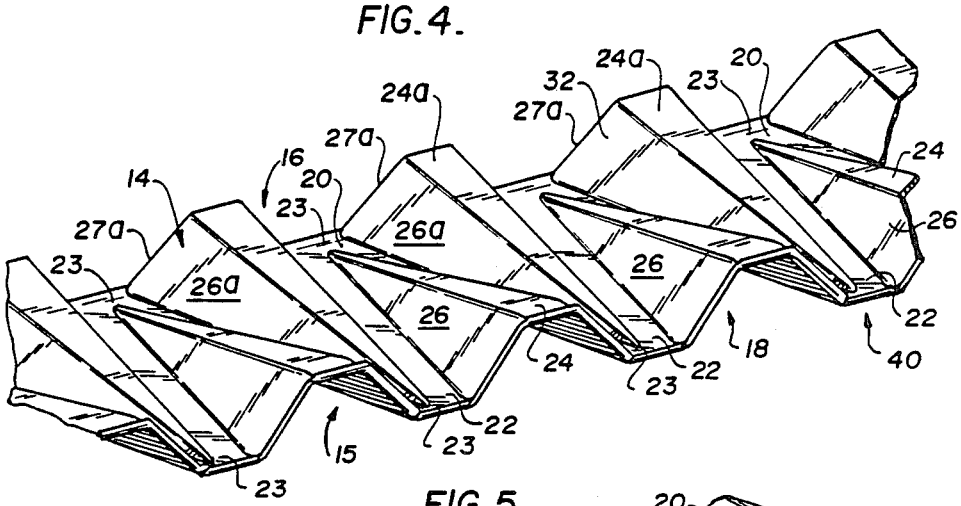
Figure 5:
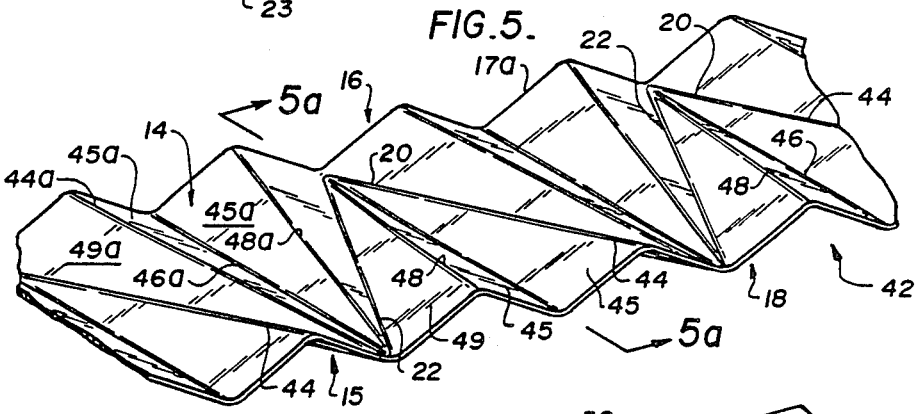
Figure 6:
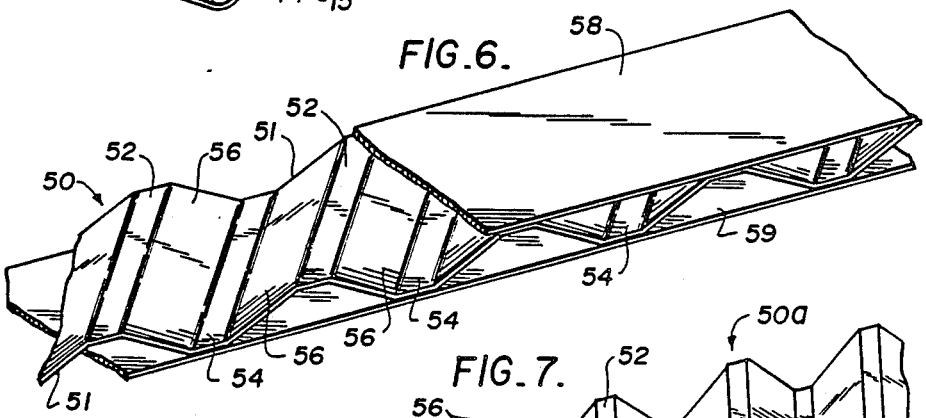
Figure 7:
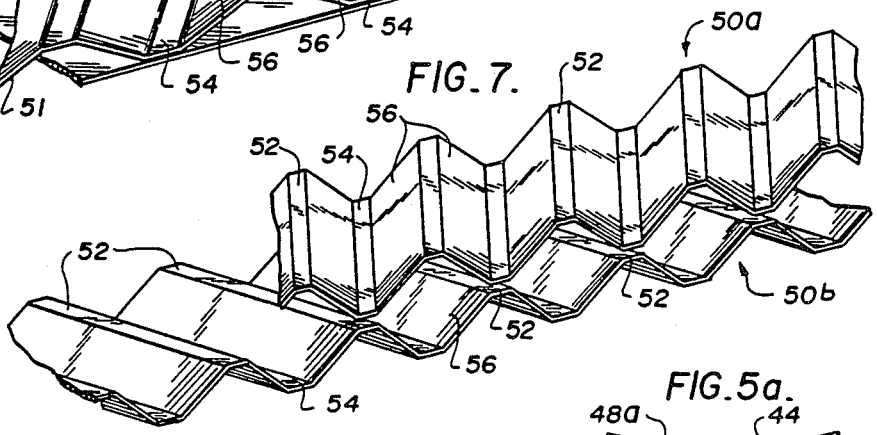
Figure 5A:
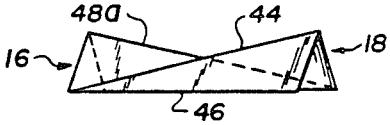
Figure 8:
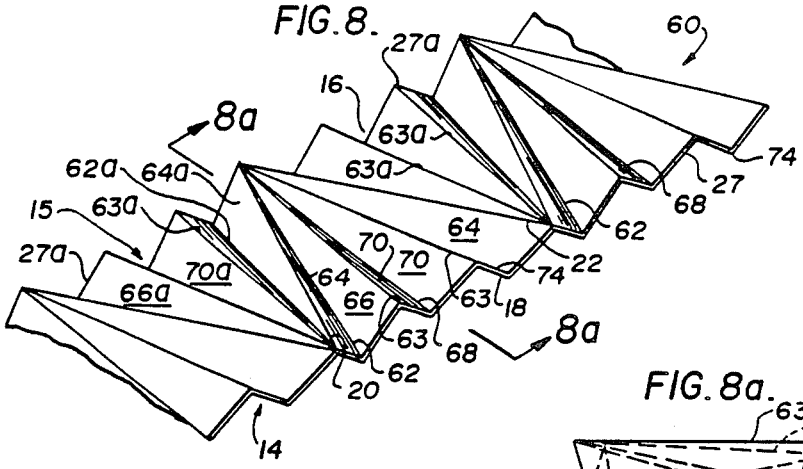
Figure 8A:
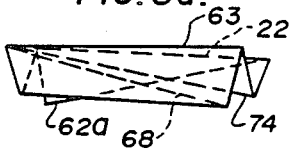
Figure 8B:
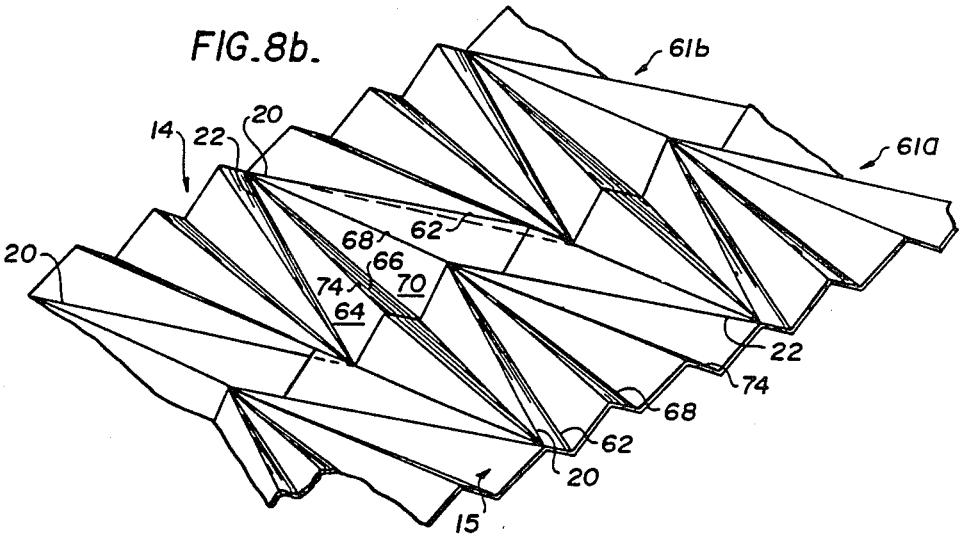
Figure 5B:
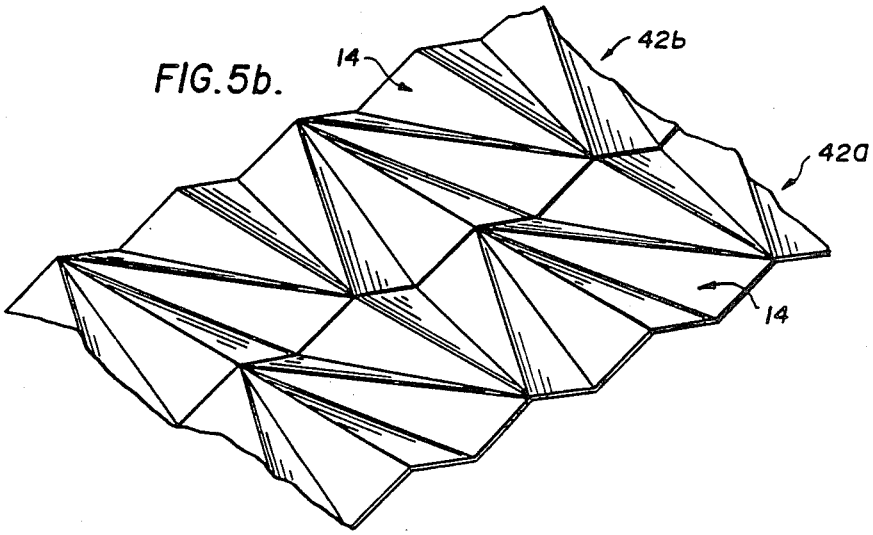
Figure 9:
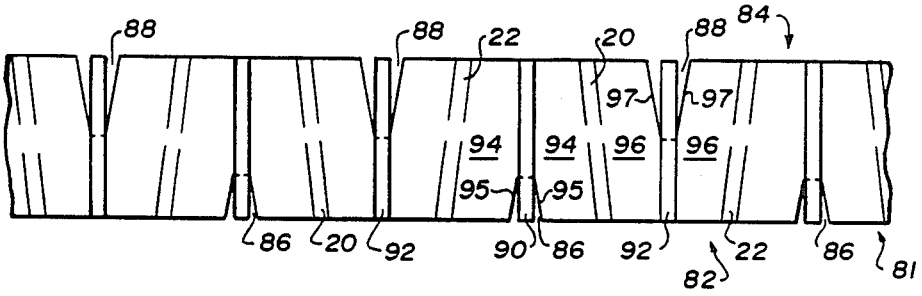
Figure 9A:
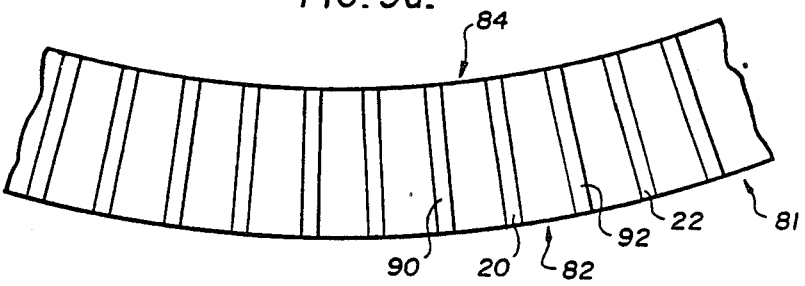
Figure 9B:
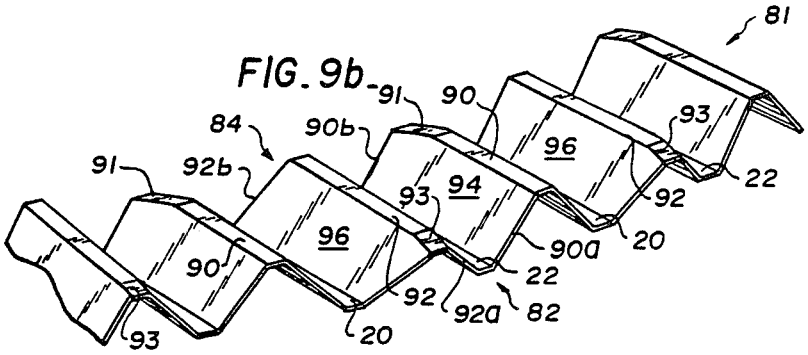

FIG. 2*a* is a cross-sectional view along the line 2*a*—2*a* of FIG. 2;

FIG. 3 is a perspective view of a structural surface being constructed with a plurality of panels of the type shown in FIG. 2;

FIG. 3*a* is a cross-section of a portion of a structural surface constructed with a plurality of panels of the type shown in FIG. 2, in conjunction with a plurality of further panels;

FIG. 4 is a perspective view of an alternate form of the panel of the present invention;

FIG. 5 is a perspective view of a further panel of the present invention;

FIG. 5*a* is a cross-sectional view along the line 5*a*—5*a* in FIG. 5;

FIG. 5*b* is a perspective view of a portion of a panel structure utilizing a plurality of panels of the type in FIG. 5;

FIG. 6 is a perspective, partially broken away view of a panel structure utilizing another form of the panel of the present invention;

FIG. 7 is a perspective view of another panel structure utilizing the panel shown in FIG. 6;

FIG. 8 is a perspective view of a further panel of the present invention;

FIG. 8*a* is a cross-sectional view along the line 8*a*—8*a* of FIG. 8;

FIG. 8*b* is a perspective view of a portion of a structure surface utilizing a plurality of the panels of FIG. 8;

FIG. 9 is a plan view of a flat blank cut in a shape to produce the panel of FIGS. 9*a* and 9*b;*

FIG. 9*a* is a plan view of another panel of the present invention, folded from the blank of FIG. 9;

FIG. 9*b* is a perspective view of the panel of FIG. 9*a;*

Figure 9C:
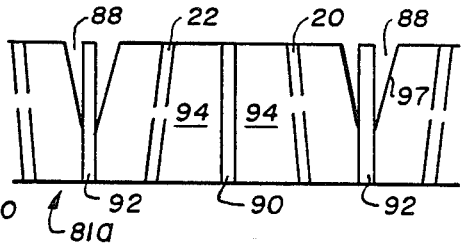

FIG. 9*c* is a plan view of another blank cut in a shape to produce the panel of FIG. 9*a;*

Figure 10:
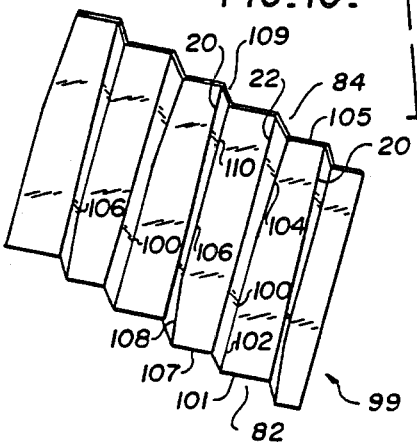
Figure 11:
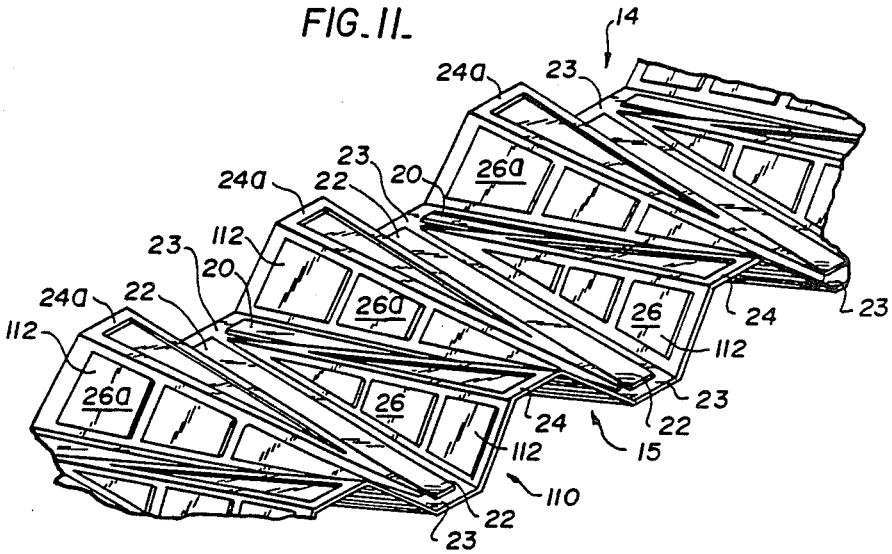
Figure 10A:
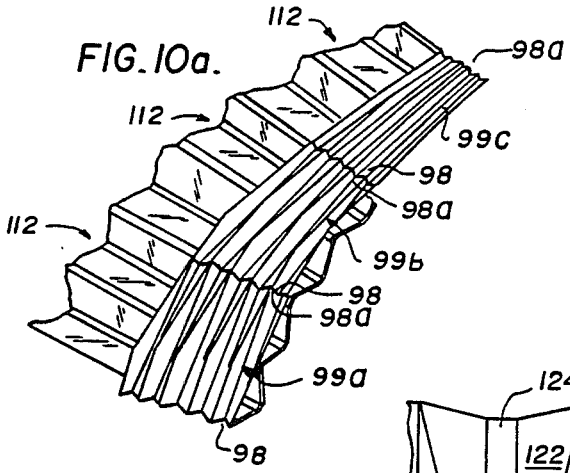
Figure 12:
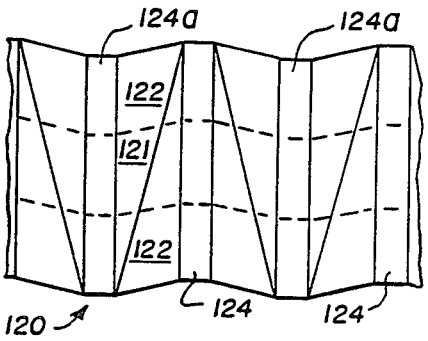
Figure 13:
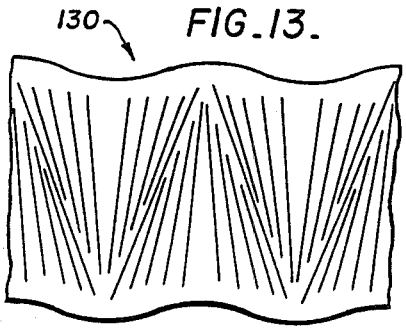
Figure 12A:
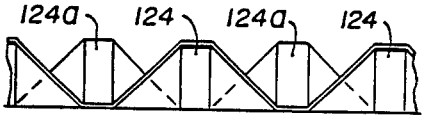
Figure 13A:
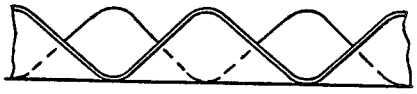

FIG. 10 is a perspective view of another panel of the present invention;

FIG. 10*a* is a perspective view of a structure surface constructed utilizing a plurality of panels of the type of FIG. 10, with portions thereof removed to show reinforcing panels;

FIG. 11 is a perspective view of a portion of a further panel of the present invention;

FIG. 12 is a plan view of a further panel of the present invention;

FIG. 12*a* is a side edge view of the panel shown in FIG. 12;

FIG. 13 is a plan view of a further panel of the present invention;

FIG. 13*a* a side edge view of the panel shown in FIG. 13.

Figure 14D:
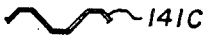
Figure 14A:
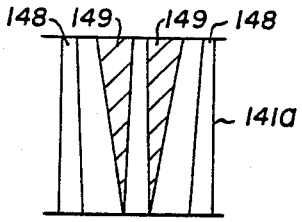
Figure 14E:
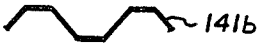
Figure 14B:
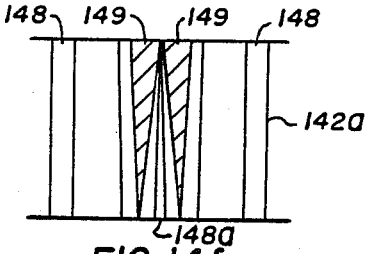
Figure 14F:
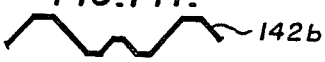
Figure 14C:
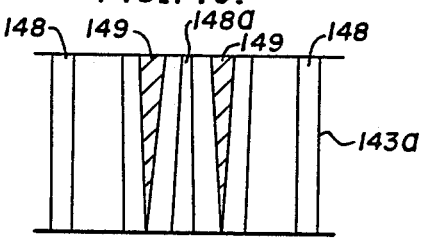
Figure 14G:
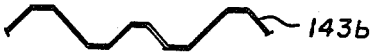
Figure 14:
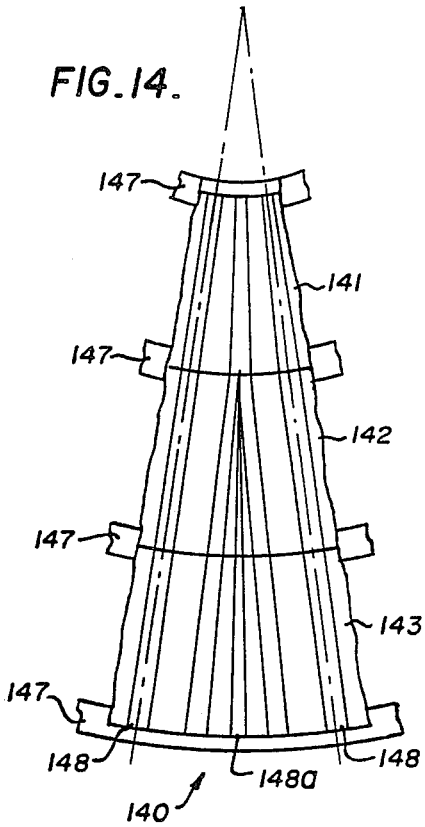
Figure 15A:
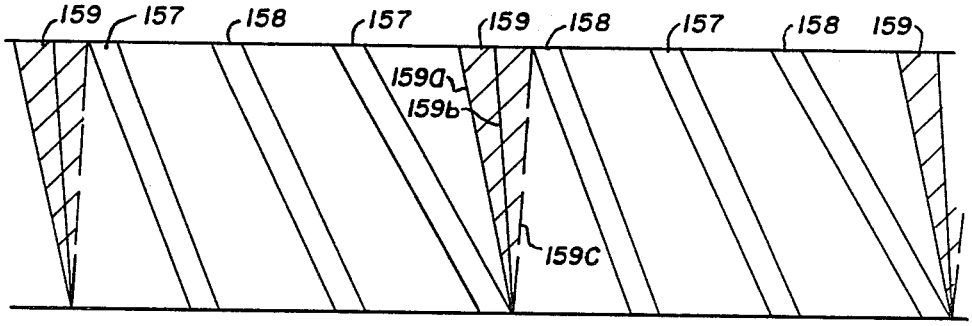
Figure 18D:
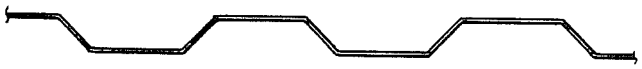
Figure 18A:
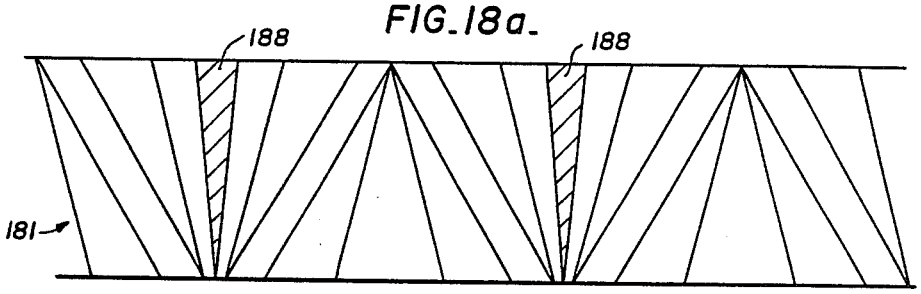
Figure 18C:
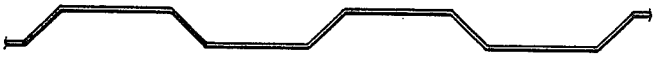
Figure 18:
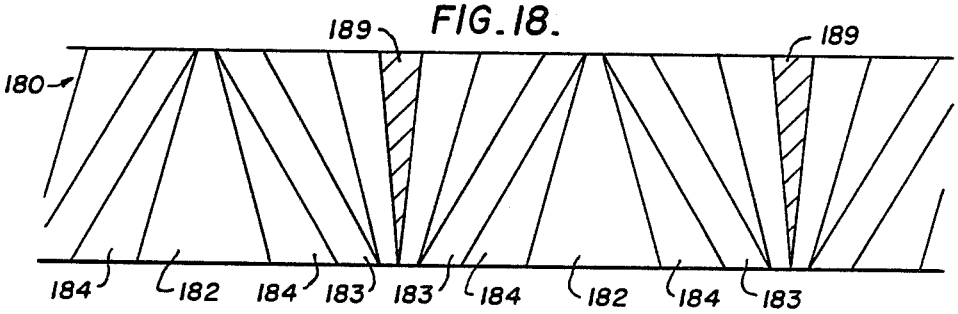
Figure 18B:
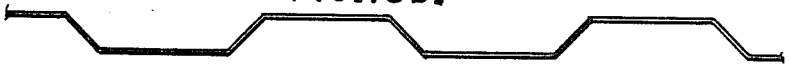
Figure 19A:
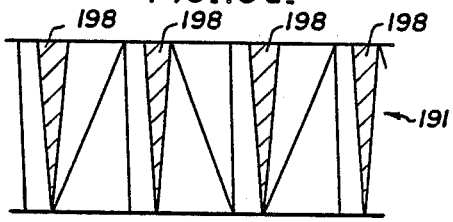
Figure 19D:
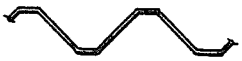
Figure 19C:
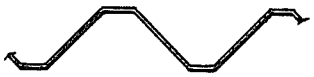
Figure 19:
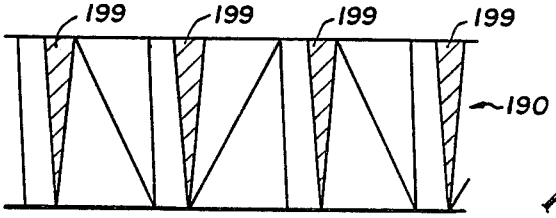
Figure 19B:
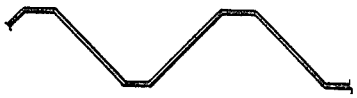

FIG. 14 is a plan view of a converging segment formed from three panel strips;

FIG. 14*a* is a plan view of a flat blank marked in a shape to produce the first panel of FIG. 14;

FIG. 14*b* is a plan view of a flat blank marked in a shape to produce the second panel of FIG. 14;

FIG. 14*c* is a plan view of a flat blank marked in a shape to produce the third panel of FIG. 14;

FIG. 14*d* is the upper side edge view of the first panel blank after folding;

FIG. 14*e* is the lower side edge view of the first panel blank after folding which corresponds to the upper side edge view of the second panel blank after folding;

FIG. 14*f* is the lower side edge view of the second panel blank after folding which corresponds to the upper side edge view of the third panel blank after folding;

FIG. 14*g* is the lower side edge view of the third panel blank after folding;

FIG. 15 is a perspective view of a structure surface constructed utilizing a plurality of panels of the type of FIG. 15*a*, with portions thereof removed to show a reinforcing panel;

FIG. 15*a* is a plan view of a flat blank related to the panel shown in FIG. 9*a*, with the corrugations set at an oblique angle to the side edge;

FIG. 16 is a plan view of a flat blank related to the panel shown in FIG. 2 marked for folding;

FIG. 16*a* is a plan view of another flat blank related to the panel shown in FIG. 2 marked for folding;

FIG. 16*b* is the lower side edge view of the panel shown in FIG. 16 after folding;

FIG. 16*c* is the upper side edge view of the panel shown in FIG. 16 after folding, which corresponds to the lower side edge view of the panel shown in FIG. 16*a* after folding;

FIG. 16*d* is the upper side edge view of the panel shown in FIG. 16*a* after folding;

FIG. 17 is a plan view of a flat blank related to the panel shown in FIG. 5 marked for folding;

FIG. 17*a* is a plan view of another flat blank related to the panel shown in FIG. 5 marked for folding;

FIG. 17*b* is the lower side edge view of the panel shown in FIG. 17 after folding;

FIG. 17*c* is the upper side view of the panel shown in FIG. 17 after folding which corresponds to the lower side edge view of the panel shown in FIG. 17*a* after folding;

FIG. 17*d* is the upper side edge view of the panel shown in FIG. 17*a* after folding;

FIG. 18 is a plan view of a flat blank related to the panel shown in FIG. 4 marked for folding;

FIG. 18*a* is a plan view of another flat blank related to the panel shown in FIG. 4 marked for folding;

FIG. 18*b* is the lower side edge view of the panel shown in FIG. 18 after folding;

FIG. 18*c* is the upper side edge view of the panel shown in FIG. 18 after folding which corresponds to the lower side edge view of the panel shown in FIG. 18*a* after folding;

FIG. 18*d* is the upper side edge view of the panel shown in figure 18*a* after folding;

FIG. 19 is a plan view of a flat blank related to the panel shown in FIG. 12 marked for folding;

FIG. 19*a* is a plan view of another blank related to the panel shown in FIG. 12 marked for folding;

FIG. 19*b* is the lower side edge view of the panel shown in FIG. 19 after folding;

FIG. 19*c* is the upper side edge view of the panel shown in FIG. 19 after folding which corresponds to the lower side edge view of the panel shown in FIG. 19*a* after folding;

FIG. 19*d* is the upper side edge view of the panel shown in FIG. 19*a* after folding;

DESCRIPTION OF THE PREFERRED EMBODIMENTS

Referring first to FIG. 2, an elongated panel 13 is shown, the panel having an upper face 14, and a lower face 15. In this regard, it should be noted that terms such as "lower", "upper", and the like, are used throughout this application in a relative sense only, as will become apparent. The panel 13 is formed by folding an elongated flat sheet, with parallel side edges, into a series of converging corrugations, alternating in direction. The corrugations are formed by folding the pair of triangular elements 26, about the ridge 24, such that their apexes meet at the side edge 27*a*, and then folding the adjacent pair of triangular elements 26*a*, about the ridge 24*a*, such that their apexes meet at the adjacent side edge 27. The bases of the converging corrugations are defined by coplanar folds 20 and 22 which are at an oblique angle to the edge of the panel. Folds 24 and 24*a* which form the ridges are generally perpendicular to the side edge, and alternate in direction as most clearly shown in FIG. 2*a*. FIG. 2*a* also demonstrates that if the folded ridges 24 and 24*a* are perpendicular, the side edge portions 27 and 27*a* are at right angles to the ridges 24 and 24*a* and insloping with respect to the lower face 15 of the panel strip. Due to the foregoing construction, either side edge of a panel 13 can mate with an adjacent, parallel side edge of another such panel 13, when a pair of adjacent panels are laterally inclined toward one another. Such an arrangement is shown in FIG. 3.

It should be noted that where the panel 13 desired is of a width greater than that which might be conveniently folded from available sheet metal coil stock, such panel 13 could be assembled from lengthwise sections of panel 13, such as three sections joined along broken lines 33 and 34 in FIG. 2. It will be noted in such case that the folds are still arranged on lines which define the converging corrugations, although such panel sections (which may themselves also be referred to as panels) themselves would only contain truncated sections.

In FIG. 3, a number of panels 13*a*, 13*b*, 13*c*, 13*d*, 13*e* and 13*f* are connected together, each of the foregoing panels being of the same construction as panel 13 of FIG. 2. Panels 13*b* and 13*c*, are disposed with their lower faces 15 facing upward as viewed in FIG. 3. Adjacent side edges of panels 13*a* and 13*b* are then overlapping somewhat, and are connected together in the manner shown. Due to the insloping side edge portions 27, 27*a* of the transversely triangular sections as previously described, when panels 13*a*, 13*b* and 13*c* are connected together in such an arrangement as in FIG. 3, the structure surface shown curves convexly upward as one moves laterally across panels 13*a* to 13*c*, as viewed in FIG. 3. Such a curvature can be continued if desired. Alternatively, the next panel 13*d* can be inverted with respect to panels 13*a* through 13*c*, that is disposed with its upper face 14 facing upward as viewed in FIG. 3, and again adjacent side edges of panels 13*c* and 13*d* can be overlapped and connected together due to the symmetry of the side edges of the panels. With panel 13*d* inverted, a reversing of the direction of curvature of the structure takes place, which is further carried on by panels 13*e* and 13*f* also disposed with their upper faces 14 facing upward as viewed in FIG. 3. Thus, as one moves laterally across the panels, from panel 13*c* to panel 13*f*, the curvature of the structure surface is concave upward as viewed in FIG. 3.

It should be noted that panels 13*a* and 13*b* are laterally inclined to one another, as are panels 13*b* and 13*c*, and panels 13*d*, 13*e* and 13*f*, the inclination being judged with reference to the fact that the planes in which folds 20, 22 of the foregoing sets of panels lie are inclined toward one another. However, in the case of panels 13*c* and 13*d*, such planes are parallel, and therefore those panels can be considered not to be inclined to one another. As a result, a structure surface which is essentially planar, is formed when panels 13 are alternatively inverted with respect to each other.

It will be appreciated that the degree of curvature can be controlled by decreasing the height of the folded triangular sections, namely decreasing the vertical distance as viewed in FIG. 2, between the uppermost ends of ridge folds 24, 24*a* and adjacent base folds 20, 22. Lowering such distance (i.e. lowering the angles which the faces 26, 26*a* make to a plane in which folds 20, 22 lie to make the panel more flat), will decrease the angle of curvature which can be obtained by joining two such panels along their adjacent edges. However, by lowering such height the load which such panels can bear in the lateral direction, also tends to decrease. Thus, in cases where it is desired to have a lower angle of deflection, but the angle which faces 26, 26*a* make to the plane as described, is to be maintained constant in order to maintain structural strength of the panel, then the panel can be folded from sheet material with parallel side edges such that each folded triangular section has a plurality of corrugations converging at one side edge. Such an arrangement is shown in the panels of FIGS. 5, 5*b*, 8, and 8*b*.

The structure surface shown in FIG. 3, or similar structure surfaces, can be reinforced in a manner as shown in FIG. 3*a*. FIG. 3*a*, shows the six panels of FIG. 3, 13*a* through 13*f*. In addition, six elongated panels 35*a*, 35*b*, 35*c*, 35*d*, 35*e* and 35*f*, which have lengthwise extending parallel, corrugations 36, are connected to respective surfaces of panels 13*a* through 13*f*, by means of welding, bolting or the like. Thus, the resulting structure will be less susceptible to collapse as a result of lengthwise folding of panels 13*e* through 13*h* lengthwise, than if such reinforcing panels 35*c* through 35*h*, had not been present. In addition the spaces between panels 13 and the reinforcing panels can act as insulating dead air spaces in the structure surface, or such spaces can be filled with a suitable insulating material if desired.

The panel 42 of FIG. 5 is similar in construction to panel 13 of FIG. 2, and analogous elements have been numbered identically. Panel 42 is formed by folding laterally converging corrugations on an elongated sheet material, with parallel side edges, in a similar manner as panel 13 is formed. Panel 42, like panel 13, has sets of folds 20, 22 defining transversely triangular elements therebetween, with ajjacent such element extending in alternate directions, as shown in FIG. 5. Each triangular element of the panel 42 though, is provided with additional folds 44, 46, 48, or 44*a*, 46*a*, 48*a* which form two ridges on the converging corrugations. Adjacent numbers of panels can be connected together along their edges in a similar manner as panels 13, already described. When the upper surfaces 14 of a plurality of panels 42 face in the same direction, then the structure surface will be concave moving laterally across such adjacent panels. In a similar manner as with panels 13, some panels 42 can be inverted with respect to others so as to produce a structure surface which is convex in the same direction. FIG. 5*b* shows two panels 42*a* and 42*b* connected together along their adjacent edges and with their upper surfaces 14 facing in the same direction. Each panel 42*a*, 42*b* is of the same construction as panel 42 in FIG. 5. The result of the arrangement in FIG. 5*b* is a structure surface which is upwardly concave as one moves laterally across the two panels shown.

Referring to FIG. 8, the panel shown therein, is similar in construction to the panel of FIG. 2, and analogous parts have again been numbered identically. However, in FIG. 8, the panel 60 therein, is viewed toward the lower face 15 thereof. The panel 60 is folded so that the converging corrugations bounded by each pair of adjacent folds 20, 22 and directed toward the first side edge 16, each contains a plurality of interior folds 62, 63, 68 and 74, and triangular faces 64, 66 and 70 to form three ridges. The converging corrugations directed or extending in the opposite direction (i.e. toward second side edge 18) are congruent with the foregoing converging corrugations, with the former having folds 62*a*, 63*a*, 68*a* and 74*a* and triangular faces 64*a*, 66*a*, and 70*a*. It will be noted from FIG. 8*a* that folds 68 and 74, 63 and 22, and 63 and 20, are not coplanar, although they could be.

When two panels 60 are joined together along adjacent edges with both of their lower surfaces 15 being oriented upward, the result would be a structure surface which is convex in the lower surface direction. Alternatively, by simply inverting one or more of such panels 60, the direction of curvature as one moves laterally across such connected panels, can be altered. However, the panels used in such arrangement, should have folds 68 and 74 coplanar, and folds 63, 20, 22 coplanar, unlike the folds of panel 60 of FIGS. 8 and 8*b*, in order to avoid gaps when joined as described. A junction of two such congruent panels 61*a* and 61*b*, each basically the same as panel 60 of FIG. 8, is shown in FIG. 8*b*. However, panels 61*a* and 61*b*, have coplanar folds 68 and 74 and coplanar folds 63, 20 and 22. Again, one panel 61*a* has its lower surface 15 facing in an opposite direction than the upper surface 14 of panel 61*b*, (i.e. the panels 61*a* and 61*b* are inverted with respect to one another). Such an arrangement by itself produces a structure surface which is essentially planar, which essentially planar arrangement could be continued by repeatedly inverting the direction in which the respective faces of a plurality of such adjacent panels face. It might be noted that in joining adjacent panels of a type of panel 61*a* or 61*b*, with corresponding faces facing in the same direction, the edges of such panels must be offset in a lengthwise direction of the panels, by two folds, (i.e. one "cycle"), in order to obtain reasonably good mating of the respective side edges of the panels.

Referring now to FIG. 6, a panel structure is shown, which utilizes a panel 50, which may be conveniently referred to as first panel 50, along with two reinforcing panels 58. Panel 50 is also formed by folding an elongated sheet, such as sheet metal, which has parallel side edges. Panel 50 has two opposed side edges 51, and a first set of coplanar, parallel faces 52 each of parallelogram configuration, and extending between side edges 51 at an angle of approximately 45 degrees. A second set of coplanar, parallel faces 54 are further provided which are parallel and congruent with faces 52, and which are disposed in alternating relationship therewith, in a plane parallel to that in which the first set of faces 52 lie. Sloping faces 56, also of parallelogram configuration, extend between each pair of adjacent faces 52, 54. It will be noted that sloping faces 56 are alternately oriented 180 degrees with respect to one another, but are nevertheless congruent. Reinforcing panels 58, 59 extend parallel with first panel 50, and have respective faces contacting and connected to respective adjacent faces of first panel 50, by means of welding or the like. Thus, reinforcing panel 58 will actually contact and be connected to faces 52, while reinforcing panel 59 will actually contact and be connected to faces 54. Reinforcing panels 58, 59 serve to carry at least partially, longitudinal tension and compression forces on the panel structure 50. Such forces might otherwise tend to cause panel 50 to fold up or buckle along faces 52, 54. In addition, the spaces between faces 54 and panel 58, and faces 52 and panel 59, can additionally act as insulating dead air spaces in a structure surface. Furthermore, if desired, such spaces can be filled with a suitable insulating material to increase the insulating value of the panel structure of FIG. 6.

Referring to FIG. 7, a panel structure is shown which utilizes two panels 50*a*, 50*b*, each of the same construction as panel 50, disposed parallel to one another and inverted relationshp, with adjacent connected faces. In particular, faces 54 of panel 50*a* are connected by means of welding or the like, to faces 52 of panel 50*b*. Thus, the two panels 50*a*, 50*b* are oriented such that the faces on panel 50*a* extend across the panel structure of FIG. 7, in a direction opposite to that of the faces of panel 50*b*, in particular at 90 degrees with respect thereto. This arrangement also provides spaces between panels 50*a* and 50*b* which can act as insulating spaces in a similar manner as described in connection with the panel structure of FIG. 6. In addition though, this panel structure will also resist longitudinal compression forces far better than if panels 50*a* and 50*b* were oriented so that their faces were all parallel. Furthermore, construction of such a panel structure is convenient, and relatively efficient, since the same panels need only be manufactured, with some panels being inverted with respect to other such panels and then connected thereto. It will be appreciated that the faces of panels 50*a* and 50*b* could extend at an angle other than 45 degrees to the side edges of the respective panels. However, 45 degrees is preferred so that a given panel obtains maximum resistance to both lateral and longitudinal compression forces.

Referring now to FIGS. 9*a* and 9*b*, a panel 81 is shown, which has arcuate, generally parallel, first and second side edges, 82 and 84 respectively. Panel 81 again has sets of faces 20 and sets of faces 22 which are arranged on lines which define converging corrugations comprised of congruent folded, tranversely triangular elements, extending laterally across the panel. That is, the lines upon which faces 20, 22 lie, intersect to define such complete triangular sections, although panel 81 itself contains only truncated elements. In the case of panel 81 though, these elements are all radially aligned (i.e. directed toward a common center of a circle defined by panel 81). Panel 81 further has faces 90, 92, and sloping faces 94, 96 which form converging corrugations. The first side edge 82 has a greater radius of curvature than second side edge 84. Faces 90, 92 have respective second linear portions 91, 93, which extend downward at an angle to the remainder of the respective faces, such that a second side edge portion **90*b* of the corrugation containing each face 90, is lower than the opposite first side edge portion 90*a*, while a first side edge portion 92*a* of each face 92 is lower than the opposite second side edge portion 92*b*. Thus, first side edge portions 92*a* of a first set of alternate truncated elements are lower than respective opposite second side edge portions 92*b*, while second side edge portions 90*b* of a second set of alternate truncated elements, are lower than respective opposite first side edge portions 90*a*. Furthermore, although linear portions 91, 93 extend downward at approximately the same angle, portions 91 are longer than portions 93. This means that second side edge portions 90*b* of the truncated elements of the second set (those containing faces 90), are lower than first side edge portions 92*a* of the truncated elements of the first set (those containing faces 92**).

Panels 81 can be produced from an elongated sheet with parallel side edges, such as sheet metal coil stock. FIG. 9 shows panel 81 marked before folding, which is similar in shape to the middle strip 121 of panel 120 shown in FIG. 12, and indicates how such an elongated sheet is formed into a panel 81. This is accomplished by cutting out darts 86, 88, from the sheet as illustrated, the darts 86, 88, being of equal angle, but darts 88 being greater in length (thereby having a wider base or greater maximum width). The sheet is then folded into the shape of the final panel 81, with face portions 91 and 93 being bent downward to contact edge portions 97 and 95 respectively, and welded thereto. Alternatively, the foregoing darts could be folded on the sheet while shaping. Since the darts 88 cut out of the panel have a wider base than darts 86, second side edge 84 will have a lower radius of curvature than first side edge 82. It should be noted at this point, that the arcuate shape of the folded panel 81 is a result of the shortening of the second side edge with respect to the first side edge, and can also be accomplished by forming darts 88 only on the second side edge and eliminating darts 86 on the first side edge. This method is shown by panel strip **81*a* of FIG. 9*c*, which when folded will give the same appearance as folded strip 81 shown in FIG. 9*a*. Panel 81 is particularly useful for constructing dome type structures in a manner similar to that described below in connection with panels 99, one of which is shown in FIG. 10**.

Referring now to FIG. 10, another panel 99 is shown, which is similar to the middle strip of panel 13 shown in FIG. 2, and includes a first side edge 98 and a second side edge **98*a*. Panel 99 is similar in construction to panel 81, except that the "faces" of panel 99 are single folds (i.e. appear as lines in the Figures). Again, sets of folds 20, 22 are provided, which lie on lines which again converge to define, radially aligned, transversely triangular elements which are all "directed toward" second side edge 98*a* (that is folds 20, 22 defining the truncated elements converge in the direction of second side edge 98*a*). As in the case of panel 81 of FIG. 9*b*, panel 99 actually has only truncated elements on it. Both side edges 98, 98*a* are curved, with first side edge 98 having a greater radius of curvature. Alternate, laterally converging corrugations include respective folds 100, 106. Each fold 100 has a first linear portion 102, and a second linear portion 104 extending downward at an angle to portion 102 (i.e. toward folds 20, 22) such that a second side edge portion 105 of the element containing each fold 100, is lower than the opposite first side edge portion 101 of the same element. Thus, it can be said that first side edge portions 107 of a first set of alternate truncated elements containing folds 106, are lower than respective opposite second side edge portions 109. Likewise, second side edge portions 105 of a second set of truncated elements containing folds 100, are lower in height than respective opposite first side edge portions 101. Furthermore, the second side edge portions 105 of the truncated elements of the second set (i.e. those elements containing folds 102), are lower than the first side edge portions 107 of the elements directed toward them (i.e. those elements containing folds 106**).

Panel 99 can be formed in a manner similar to panel 81 of FIG. **9*b*, that is by folding or cutting appropriate darts on one or both of the side edges of an elongated sheet having parallel side edges, at positions thereon at which fold portions 104 and 108 will be formed. When darts are formed on both side edges, the darts at which portions 104 are formed, will of course be longer than those at which portions 108 are formed. The sheet is then shaped to form folds 20, 22, 100, 106, with portions 104, 108 being formed by joining edge portions of corresponding faces where the darts are located. Thus, panel 99 is basically formed in the same manner as panel 81 except that the parallelogram shaped face portions of panel 81** are replaced by folds which appear as lines.

FIG. **10*a* illustrates construction of a dome utilizing a plurality of panels 99*a*, 99*b*, 99*c*, each constructed in the manner of panel 99 in FIG. 10. In each case, second side edge 98*a* of each of a plurality of panels 99*a*, 99*b* (only a portion of the length of each of such panels being shown in FIG. 10*a* so as to reveal the underlying structure), is mated with, and connected to, a first side edge 98 of respective adjacent panels 99*b*, 99*c*. Thus, panel 99*b* is inclined downward as viewed in FIG. 10*a*, with respect to panel 99*a*. Likewise, panel 99*c* is inclined downward with respect to panel 99*b*. Of course, it will be appreciated that as one moves up the dome-shaped structure surface shown in FIG. 10*a*, panels must be utilized which have a first side edge 98 with a radius of curvature and other dimensions approximately the same as the second side edge 98*a* of the next lower panel. However, as the dome will usually be relatively large in diameter, this allows a large number of identical panels to be produced for each annular layer of panels 99*a*, 99*b*, 99*c*,** and other such layers.

In the structure of FIG. **10*a*, reinforcing panels 112 are also provided, which again can be manufactured from sheet metal coil stock, but with corrugations which extend in a direction lengthwise thereon. Panels 112 have surfaces which are connected to adjacent surfaces of panels 99*a*, 99*b*, 99*c*. Such an arrangement reinforces the structure surface against tension and compression forces which might otherwise tend to warp panels 99a, 99b, 99c, if reinforcing panels 112** were not provided.

Figure 1:
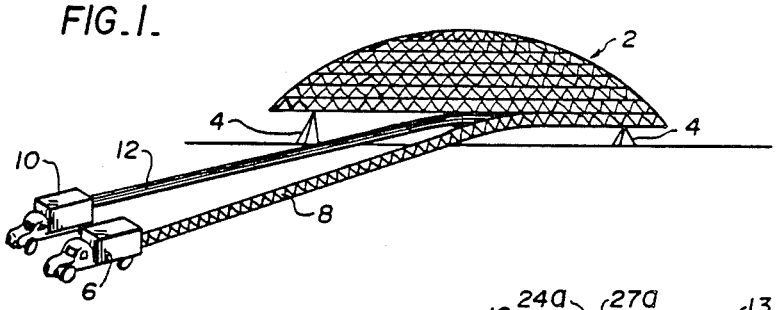
FIG. 1 is a perspective, schematicized view of a structural surface being constructed in accordance with a method of the present invention.

In constructing a dome structure such as that in FIG. 10a, it is possible to utilize a method such as that schematically illustrated in FIG. 1. In FIG. 1, the dome structure surface is labelled 2. Such structure surface 2 is mounted upon supports 4, which are capable of raising the structure up as desired. Two trucks 6, 10 can be provided contain supplies of sheet metal coil stock, as well as equipment for folding the same. Such equipment feeds out elongated panels 8 with transverse converging corrugations thereupon, and elongated panels 12 with faces extending in a direction lengthwise thereupon. Panels 8 can be arranged to overlie, and be connected to adjacent corresponding panels 12. As each annular layer is added on, an upper side edge of the newly added, lower panel or panel structure, is connected by suitable means such as welding, bolting, or the like, to a mating side edge of an upper adjacent panel. The structure is then raised, and the foregoing process repeated for a new annular layer.

It will be appreciated that as part of a structure under load the various panels will be subjected to bending moments resulting in high stresses in the elements farthest from the central plane of the panel strip. For panel 13 shown in FIG. 2 the stresses would be maximum in the folds 20, 22, 24 and 24a, and for panel 99 shown in FIG. 10 the stresses would be maximum in folds 20, 22, 100 and 106. It is of considerable benefit if the cross-sectional area of these folded sections can be widened by the introduction of planar elements, which in turn will reduce the unit stresses imposed by the load. One such arrangement is shown in a panel 40 of FIG. 4. Panel 40 is similar in construction to panel 13 of FIG. 2, and again analogous parts have been numbered identically. However, in panel 40, folds 20 and 22 are replaced by a quadrilateral planar element, while folds 24 and 24a are replaced by a triangular planar element. As well edge portions 23 at the intersection of faces 20, 22 will have a slight upward turn as a result of the folding operation. However, such will not interfere with the connection of like panels, and in fact assist such connection. With this configuration, it should be noted that the maximum width of faces 24 must be approximately equal to the sum of the widths of faces 20 and 22; in order to ensure a reasonably good mating of adjacent edges of two panels with side surfaces facing in opposite directions. In addition, the maximum strength of such a panel 40 is obtained when the width of faces 24 one half way along their length, is approximately equal to the width of each face 20, 22.

Referring now to panel 110 shown in FIG. 11 the configuration of the folds is similar to that of panel 40 of FIG. 4 and analogous parts have been numbered identically. However panel 110 has been stiffened by the patterns impressed on the surfaces of the elements comprising the panel strip. It should be noted that raised portions 112 of panel 110 are particularly important in maintaining the side edges of panel 110 rigid, so that when two such panels are interconnected, less points of attachment will be required to maintain a good connection than if equivalent sized panels 40 were used. Another method of stiffening the side edges is to double the sheet thickness by rolling edge strips on the sheet before shaping. The rolled edge will also facilitate handling and strengthens connections of the panel strips.

A portion of other possible panels is shown in FIGS. 12 and 13. Again these panels are of the same basic pattern, namely a panel strip comprised of tranversely folded converging corrugations alternating in direction. Panel 120 of FIG. 12 demonstrates a configuration where the folds 24 and 24a of FIG. 2 have been replaced by rectangular planar surfaces 124, 124a thus increasing the load bearing capacity of the panel strip. FIG. 12a shows how the planar surfaces 124, 124a add strength by increasing the width of the elements farthest from the central plane. This configuration is of particular benefit where bending moments are unidirectional such as arched structures. Panel 130 of FIG. 13 shows a panel where the converging corrugations are formed by a multiplicity of folds into curved shapes. The curved configuration, reduces the high stress concentrations sometimes encountered in sharp folds, and gives a somewhat different architectural appearance. FIG. 13a is a view showing the edge of the panel and the curved shape of the corrugations. A section through the middle of the panel strip would be similar in shape, but the amplitude of the curves would be reduced. Panels 120 and 130 are similar to panel 13 of FIG. 2 in that identically shaped panels can be connected at their side edges in the inverted or normal positions, they can be reinforced by longitudinally folded panels, and can be stiffened by impressing patterns on their surfaces. In addition, where the width of available coil material is not sufficient, the panel strip can be comprised of more than one segment as demonstrated by middle strip 121 and side strips 122 of FIG. 12.

FIG. 14 shows a segment 140 of a dome whose panels are shaped similarly to those of FIG. 9. In FIG. 14, however, converging corrugations 148, whose ridges are comprised of parallel folds, alternate with rapidly converging corrugations 148a that have one edge shortened by darts 149 extending across the width of the panel strip. When folded all of the corrugations are radially aligned converging towards the centre of the dome. Three folded panel strips 141, 142, 143 whose length between corrugations 148 increases with the distance from the centre point of the dome are shown joined together to form segment 140. The three folded panel strips comprising segment 140 are shown before folding as panel strips 141a, 142a, 143a. Cross sections 141b, 142b, 143b show the folded lower edge of the respective strips, which are identical to the upper edge of the adjacent panel strip. Cross section 141c shows the folded upper edge of panel 141.

Continuous reinforcing strips 147 are provided at each circumferential joint for attachment of the external and internal panel strips. These reinforcing strips are sized to withstand the tensile forces which occur when the dome is under load and to provide separation if desired between internal and external panel strips. It can be seen that by varying the dimensions of the panel strips many geometrically shaped structures including spheroids ellipsoids, paraboloids and hyperboloids can be simply constructed by joining continuous folded panel strips formed on site.

FIG. 15 shows a segment 150 of another dome whose panel strips are shaped similarly to FIG. 9. In FIG. 15, however, converging corrugations 156, whose ridges 157 and valleys 158 are comprised of parallel or gradually converging folds, are situated at an oblique angle to the side edge of the panel strip. Panel strip 151 is joined face to face with an identical panel strip 151a, turned and for end so that the ridges 157a slope in the opposite direction. Panel strips 151 and 151a are joined at their upper side edges to the identically shaped lower side edge of panel strips 152 and 152*a*. The converging corrugations of panel strips 152 and 152*a* are of lesser proportions than the converging corrugations or panel strips 151 and 151*a*, and the oblique angle is greater. These factors lead to the convergence of the segment 150 required to give the dome shape. The ridges 157 of the converging corrugations 156 form a series of spirals which approach a radial alignment as they near the center of the dome. On the other hand the valleys 158 between the converging corrugations 156 form a solid triangular matrix when pairs of identical panel strips are joined face to face, and then joined to adjoining pairs of a panel strips as shown in FIG. 15.

FIG. 15*a* shows the panel strip 151 before folding with the fold lines of the ridges 157 and the valleys 158 of the converging corrugation marked thereon. The location of the darts 159 is also shown, which traverse the full width of the panel strip. The darts 159 are most conventiently placed close to right angles with respect to the side edge of the panel strip, so that after folding there will be no significant misalignment of the side edge. In making the folds for the darts 159, fold 159*a* is made in one direction and fold 159*b* is made in the other direction so that when the folds are pressed flat, fold 159*a* corresponds with line 159*c*. Where the darts traverse the full width of the panel strips 140 and 150 in FIGS. 14 and 15 it is more efficient to make them by folding rather than cutting, as it avoids problems of alignment and reconnection.

FIG. 16 shows panel strip 160 marked with lines prior to forming, similar to those required for panel strip 13 shown in FIG. 2, however, the length of the upper side is to be reduced by the amount of the darts 169. The darts 169 are formed similarly to darts 159 of FIG. 15, where fold 169*a* is made in one direction, fold 169*b* is made in the other direction so that fold 169*a* corresponds with line 169*c*. FIG. 16*a* shows the adjacent panel strip 161 whose lower edge corresponds in length to the shortened upper edge of panel strip 160. The upper edge of panel strip 161 when folded along the markings will be shortened by the width of darts 168. FIGS. 16*b* and 16*c* are respectively the lower and upper side edge views of the panel strip 160 when folded into converging corrugations and FIGS. 16*c* and 16*d* are respectively the lower and upper side edge of the panel strip 161 when folded into converging corrugations. It should be noted the amplitude of the side edge corrugations shown in FIG. 16*c* is reduced in comparison to the side edge corrugations shown in FIG. 16*b* and, also the amplitude of the corrugations shown in FIG. 16*d* is reduced in comparison to the amplitude shown in FIG. 16*c*. The changes in the amplitude of the folded panel strip is controlled by the width of the darts 168, 169 and are calculated in geometric progression to produce the type of spherical structure desired.

The parent of panel strip 170 shown in FIG. 17 is panel strip 42 shown in FIG. 5, except the upper side edge of panel strip 170 will be shortened by the width of the darts 179. Panel strip 170 differs from panel strip 160 of FIG. 16 in that the alternating converging corrugation is comprised of two additional folds forming another element. This element can be reduced in one or more stages (two stages are shown in FIG. 17) so that the side edge returns to its original shape as shown in FIGS. 17*b* and 17*d*, indicating the darts have shortened the length of the section by one half. The advantage of this method of folding the converging corrugations is that it simplifies the forming operation and the amplitude of the corrugations can remain the same over the whole structure. It should be noted that panel strip 60 shown in, FIG. 8 where the alternating converging corrugation is comprised of two more additional folds can be shortened similarly to panel strip 170.

Panel strip 180 shown in FIG. 18 is a modification of panel strip 40 of FIG. 4 and will have the upper edge foreshortened by darts 189 after folding. This panel is suitable to form a spherical shape when joined to the adjacent panel strip 181 at their mating side edge shown in FIG. 18*c*. In this example the planar element 182 forming the ridge of the converging corrugation is reduced in width while maintaining the amplitude of the corrugations. As the panel strips converge toward the centre of the dome the valleys 183 between the corrugations may next be reduced in width, and after that subsequent panel strips will have the triangular sloping sides 184 of the corrugations reduced, which will reduce the amplitude. Because of the variety of alternatives available to foreshorten one side edge of the panel strip, this style of folding offers considerable versatility in the design of the spherical structures.

Panel strip 190 shown in FIG. 19 and panel strip 191 shown in FIG. 19*a* demonstrate how panel strip 120 of FIG. 12 can be modified to form spherical structures. In panel strips 190, 191 the dimensions of the converging corrugations are all reduced in the same ratio by darts 199, 198 as they approach the centre of the dome structure. The views of the side edges shown in FIGS. 19*b*, 19*c*, 19*d* show how this reduction can easily be made to suit any predetermined geometric progression. Because of the simplicity of these panel strips manufacture and erection costs will be less than with other styles, and the planar ridge design will give high strength values.

Structures formed from continuous panel strips have many advantages over other styles of construction. They can be manufactured in long sections either on or off site reducing the cost of transportation. There are many styles available offering a wide variety of structures which can be built. The flexibility of the converging corrugations gives a good range of architectural surface treatments on the interior and exterior panels of the buildings. The material comprising the panel strips can be selected to withstand the climatic and environmental conditions of a particular site. The length of joints and the number of pieces is reduced over other styles of metal buildings, lessening construction time. Joints overlap and are laid to weather preventing leakage. Structures can be constructed of two or more layers giving a dead air space which can be filled with insulation as required. Buildings made from continuous panel strips are generally lighter than other types of construction, and can easily be dismantled and relocated. The lighter unit weight of the buildings also reduces the dead loads which, combined with longitudinal segmentation of the panel strips, permits very large buildings to be constructed by this method.

As will be apparent to those skilled in the art in light of the foregoing disclosure, many alterations and modifications are possible in the practise of this invention without departing from the spirit or scope thereof. Accordingly, the scope of the invention is to be construed in accordance with the substance defined by the following claims.

I claim:

1. An integral elongated spherically curved panel strip comprising generally parallel sides and transversely folded converging corrugations extending across the panel in opposite directions, each corrugation having at least two sloping planar triangular segments which converge toward their apexes, selected corrugations having their size reduced by transversely folded triangular darts extending across the panel so as to shorten one side edge of the panel strip, such that each side edge can mate congruently with a side edge of a suitably dimensioned, similarly shaped panel strip to form a structural surface curved in two planes.

2. A panel strip as defined in claim 1 wherein the planar triangular segments are joined to a common parallel sided planar ridge.

3. A curved panel strip as described in claim 2 in which one side edge is so shortened by transversly folded darts that congruent corrugations converge on a radial alignment.

4. A curved panel strip as described in claim 3 wherein the converging corrugations are at an oblique angle with respect to the radial alignment.

5. A panel strip as described in claim 4 wherein the converging corrugations are at a suitable oblique angle to mate with and reinforce other panel strips.

6. A panel strip as defined in claim 5 further comprising a curved reinforcing panel strip having a plurality of longitudinally folded parallel corrugations, each having two rectangular faces wherein a surface of said first panel strip is connected to a respective surface of the reinforcing panel strip.

7. A panel strip as defined in claim 6 wherein said rectangular faces are separated by a planar element.

8. A method of forming a panel described in claim 1, comprising the steps of:

decoiling a flat sheet from a coil of sheet metal having parallel side edges;

stiffening and strengthening the side edges of the sheet by rolling and folding over a margin of each side edge to form a double thickness;

folding and flattening transverse darts across the flat sheet to form generally curved side edges;

punching holes in the side edge margins of the flat sheet;

stamping and pressing indentations in the flat sheet to strengthen elements and locate fold lines;

folding and cinching the flat sheet into converging corrugations;

moving and aligning the sheet through the preceding steps; and cutting the elongated panel strip to the desired length.

9. A method of constructing a structure surface comprising the steps of:

supplying continuous sheet metal from a coil stock having parallel side edges;

transversely folding said sheet metal to form converging corrugations extending across the panel in opposite directions, each corrugation being comprised of at least two sloping planar faces;

reducing the size of selected corrugations by forming transversly folded darts extending across the panel so as to shorten one side edge of the panel strip;

positioning similarly shaped panel strips with mating side edges parallel and adjacent to one another; and joining adjacent mating side edges of the panels.

10. A method as defined in claim 9 further comprising the step of transversly folding darts into said sheet metal to form a laterally curved sheet with one shortened side edge.

11. A method as defined in claim 9 further comprising the steps of:

forming a plurality of curved reinforcing panel strips from sheet metal coil stock by longitudinally folding said sheet to form a plurality of parallel corrugations having rectangular faces;

positioning said reinforcing panel strips parallel with said first panel strips with surfaces of said first panel strip adjacent to a respective surface of the reinforcing panel strip; and connecting such adjacent surfaces.

* * * * *